US005776301A

United States Patent [19]

Huang

[11] Patent Number: 5,776,301

[45] Date of Patent: Jul. 7, 1998

[54] ADHESIVE TAPE DISPENSER

[76] Inventor: Harrsion Huang, No. 23, Lin T'So Rd., Sheng Kang, Taichung Hsien, Taiwan

[21] Appl. No.: 771,833

[22] Filed: Dec. 23, 1996

[51] Int. Cl.[6] ..... B32B 31/00

[52] U.S. Cl. ..... 156/577; 156/579

[58] Field of Search ..... 156/523, 574, 156/577, 579; D19/67

[56] References Cited

U.S. PATENT DOCUMENTS

D. 354,515 1/1995 Vu ..... D19/67 X 5,110,401 5/1992 Huang ..... 156/577 X

*Primary Examiner*—James Engel

*Attorney, Agent, or Firm*—Browdy and Neimark

[57] ABSTRACT

An adhesive tape dispenser comprises a main body, a shaft jacket and a rotary wheel. The main body is composed of a handle, a cutter, and a fixed shaft on which the shaft jacket is mounted for holding a small-size adhesive tape roll. The rotary wheel is detachably mounted on the shaft jacket for holding a large-size adhesive tape roll.

1 Claim, 3 Drawing Sheets

ADHESIVE TAPE DISPENSER

FIELD OF THE INVENTION

The present invention relates generally to an adhesive tape, and more particularly to a device for dispensing the adhesive tape.

BACKGROUND OF THE INVENTION

The conventional adhesive tape dispenser is provided with a rotary wheel, which is capable of accommodating only the adhesive tape roll of a specific size. In other words, the conventional adhesive tape dispenser does not fit the tape rolls of various sizes. This implies that a variety of tape dispensers must be purchased for the adhesive tape rolls of various sizes.

SUMMARY OF THE INVENTION

The primary objective of the present invention is therefore to provide an adhesive tape dispenser with an adjustable means enabling the adhesive tape dispenser to hold and dispense the adhesive tape rolls of various sizes.

In keeping with the principle of the present invention, the foregoing objective of the present invention is attained by an adhesive tape dispenser, which comprises a main body, a shaft jacket, and a rotary wheel. The main body has a handle, a cutter, and a fixed shaft. The shaft jacket is fitted over the fixed shaft and is provided on the outer wall thereof with a plurality of parallel rails to facilitate the mounting of the tape rolls of smaller sizes. The rotary wheel is provided with an axial hole having in the inner wall thereof a plurality of parallel sliding slots engageable with the parallel rails of the shaft jacket.

The foregoing objective, features and advantages of the present invention will be more readily understood upon a thoughtful deliberation of the following detailed description of an embodiment of the present invention in conjunction with the accompanying drawings.

DETAILED DESCRIPTION OF THE INVENTION

Figure 1:
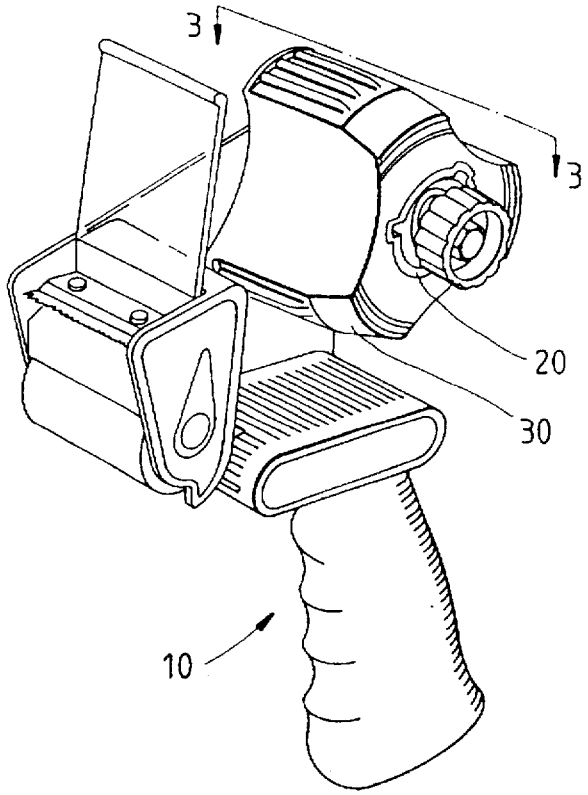
FIG. 1 shows a perspective view of the embodiment of the present invention.
Figure 3:
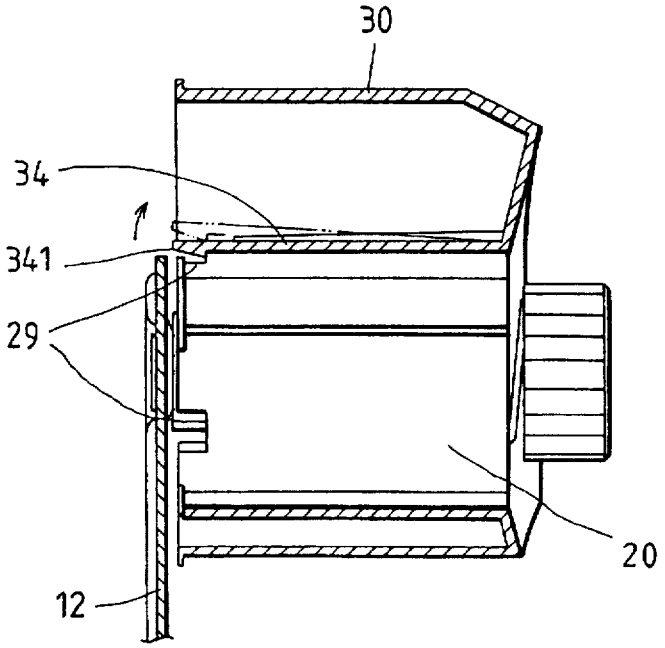
FIG. 3 shows a sectional view taken along the direction indicated by a line 3—3 as shown in FIG. 1.
Figure 2:
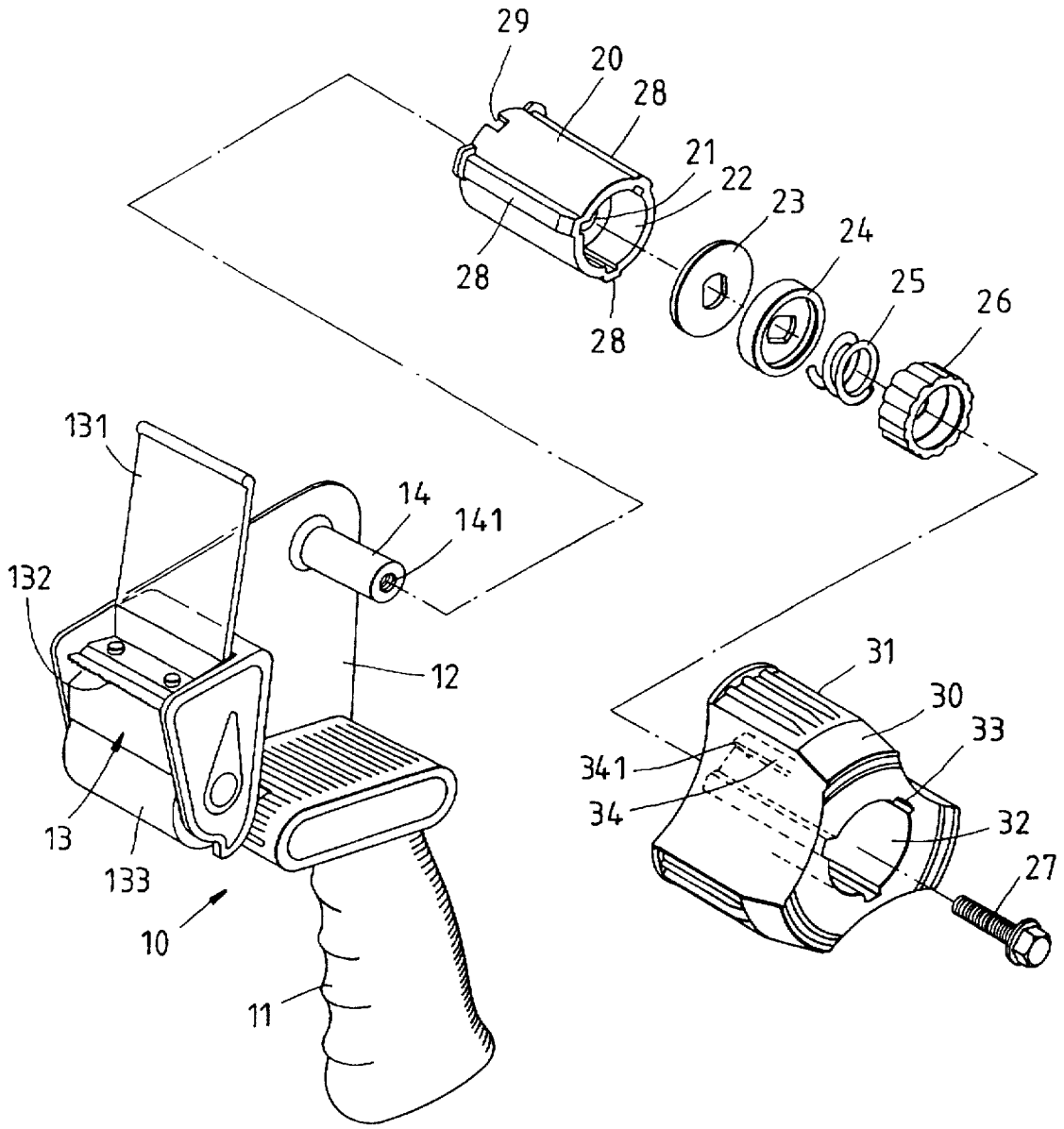
FIG. 2 shows an exploded view of the embodiment of the present invention.

The adhesive tape dispenser of the present invention comprises a main body 10, a shaft jacket 20, and a rotary wheel 30, as shown in FIGS. 1–3.

The main body 10 is composed of a handle 11, and a frame plate 12 which is provided with a cutter 13 and a fixed shaft 14 having a threaded hole 141. The cutter 13 has a stopping piece 131, a cutting edge 132 and a roller 133.

The shaft jacket 20 is tubular in shape and is provided with an axial hole 21 dimensioned to fit over the fixed shaft 14. The shaft jacket 20 is further provided with a receiving recess 22 in which a cushion ring 23, an inner press ring 24, a spring 25, and an outer press ring 26 are located. The shaft jacket 20 is secured to the fixed shaft 14 by a fastening bolt

27 engageable with the threaded hole 141 of the fixed shaft 14. The shaft jacket 20 in motion is forced to bring about a damping effect by the inner press ring 24 which is exerted on by a rotational motion of the outer press ring 26. The damping effect acts as a rotation brake between the body and the shaft jacket. The shaft jacket 20 is provided on the outer wall thereof with three protruded rails 28 parallel to one another and extending along the direction of the longitudinal axis of the shaft jacket 20. The rails 28 are intended for use in mounting the adhesive tape rolls of small sizes. The shaft jacket 20 is further provided with a plurality of cuts 29, which are located respectively at one end of the shaft jacket 20 and between two rails 28.

The rotary wheel 30 has three projected portions 31 located in the periphery thereof for accommodating the adhesive tape rolls of greater sizes. The rotary wheel 30 is provided with a center hole 32 having in the inner wall thereof three parallel slide slots 33 engageable with the protruded rails 28 of the shaft jacket 20. The center hole 32 is dimensioned to fit over the shaft jacket 20 such that the slide slots 33 are engaged with the protruded rails 28. Located between two slide slots 33 is a suspended elastic arm 34 capable of deformation and having a retaining portion 341 engageable with the cut 29 of the shaft jacket 20, as illustrated in FIG. 3. The rotary wheel can be disengaged with the shaft jacket 20 by forcing the retaining portion 341 of the deformable elastic arm 34 to disengage the cut 29. This provides a means for removably mounting the rotary wheel to the shaft jacket.

Figure 4:
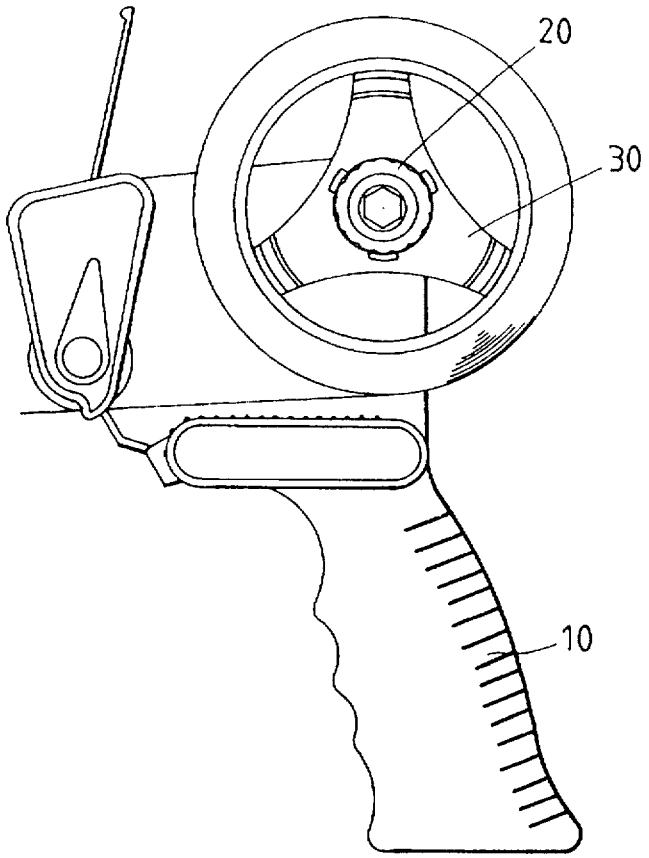
FIG. 4 shows a schematic view of the present invention at work.
Figure 5:
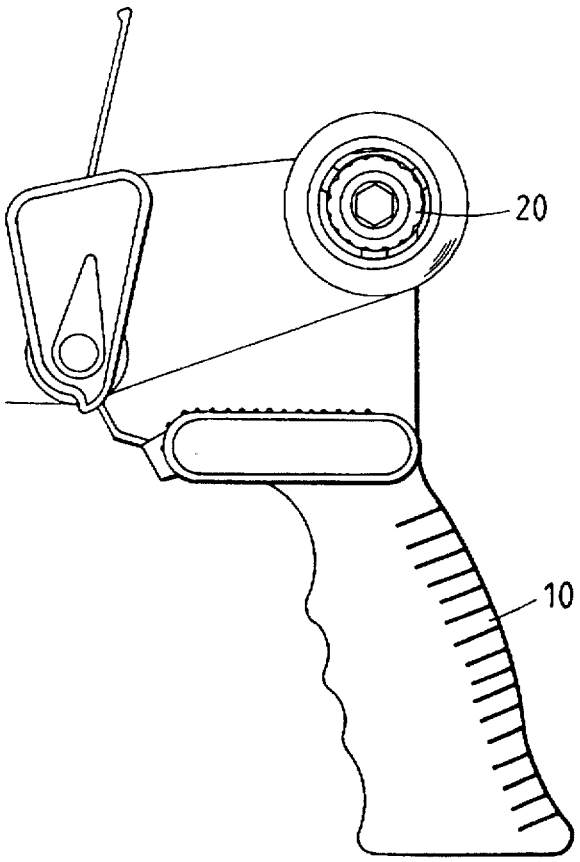
FIG. 5 shows another schematic view of the present invention at work.

As shown in FIG. 4, the rotary wheel 30 of the present invention is intended for use in mounting a large-size adhesive tape roll. On the other hand, the shaft jacket 20 is intended for use in mounting a small-size adhesive tape roll, as shown in FIG. 5. The protruded rails 28 of the shaft jacket 20 serve to locate the small-size adhesive tape roll which is mounted on the shaft jacket 20.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An adhesive tape dispenser comprising:

a main body composed of a handle, a cutter, and a fixed shaft;

a shaft jacket of a tubular construction and provided in an outer wall thereof with a plurality of parallel protruded rails extending in the direction of a longitudinal axis of said shaft jacket, said shaft jacket fitted pivotally over said fixed shaft of said main body for holding a small-size adhesive tape roll; and a rotary wheel having a center hole provided in an inner wall thereof with a plurality of slide slots parallel to one another, said rotary wheel being detachably mounted on said shaft jacket for holding a large-size adhesive tape roll such that said shaft jacket is received in said center hole of said rotary wheel, and that said slide slots of said rotary wheel are engaged with said protruded rails of said shaft jacket;

wherein said shaft jacket is provided at one end thereof with a cut; and wherein said rotary wheel is provided in said center hole thereof with a suspended elastic arm capable of deformation and having a retaining portion engageable and disengageable with said cut of said shaft jacket.

* * * * *